US007013489B1

(12) United States Patent
McGrath

(10) Patent No.: US 7,013,489 B1
(45) Date of Patent: Mar. 21, 2006

(54) LINER AND GARMENT ENSEMBLE FOR THERMAL WEAR AND ANTI-EXPOSURE SUITS

(75) Inventor: Leonard J. McGrath, Melbourne, FL (US)

(73) Assignee: McGrath Diverse Products, L.L.C., Melbourne, FL (US)

( * ) Notice: Subject to any disclaimer, the term of this patent is extended or adjusted under 35 U.S.C. 154(b) by 318 days.

(21) Appl. No.: 10/273,839

(22) Filed: Oct. 18, 2002

Related U.S. Application Data

(60) Provisional application No. 60/388,208, filed on Jun. 13, 2002.

(51) Int. Cl.
*B63C 9/08* (2006.01)

(52) U.S. Cl. ..... 2/69; 441/102

(58) Field of Classification Search ..... 2/455, 2/456, 459, DIG. 3, 102, 69, 69.5, 108, 2.15, 2/82, 59, 126; 441/102, 103, 106–108
See application file for complete search history.

(56) References Cited

U.S. PATENT DOCUMENTS 3,731,319 A 5/1973 O'Neill ..... 2/2.1 R
3,747,141 A * 7/1973 Crockford ..... 441/103
4,242,769 A * 1/1981 Rayfield et al. ..... 441/91
4,583,247 A 4/1986 Fingerhut et al. ..... 2/69
5,013,271 A * 5/1991 Bartlett ..... 441/65
5,140,721 A 8/1992 Kauffeld ..... 2/2.1 R
5,182,812 A * 2/1993 Goldsby ..... 2/79
5,274,846 A * 1/1994 Kolsky ..... 2/460
5,802,609 A 9/1998 Garofalo ..... 2/2.17
6,079,056 A * 6/2000 Fogelberg ..... 2/461

OTHER PUBLICATIONS

Public Website pages on *Sealed Air Thermal Sportswear* by Leonard J. McGrath, as modified Jan. 2001, printed from disk copy Feb. 15, 2003.

* cited by examiner

*Primary Examiner*—Tejash Patel
(74) *Attorney, Agent, or Firm*—Brian S. Steinberger; Law Offices of Brian S. Steinberger, P.A.

(57) ABSTRACT

A multi-layer liner light weight garment ensemble that offers low bulk, water impermeability, wind resistance, thermal protection, and buoyancy. The core element and essential component of the invention is the light weight sealed air polymer cellular thermal layer, interposed between the inner and outer layers. This central element can be water impermeable and offers both thermal protection and buoyancy effects. The garment ensemble can be used as a light weight thermal winter garment as well as survival apparel for those who work and play in and around water.

14 Claims, 5 Drawing Sheets

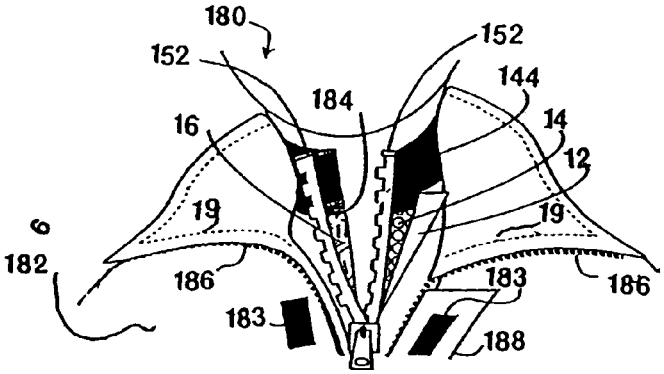
FIG. 18
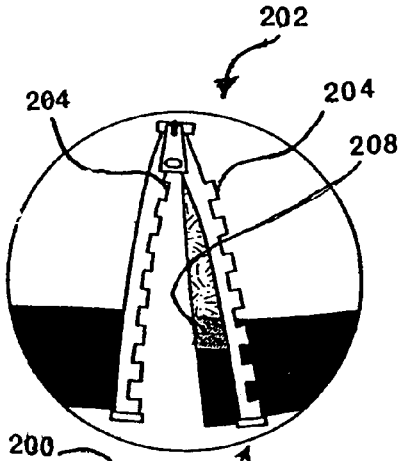
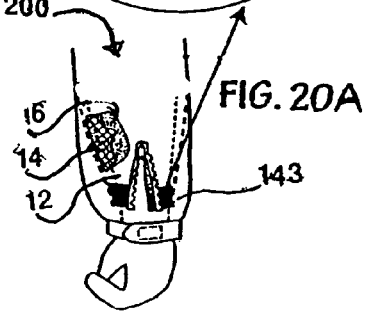
FIG. 20A
FIG. 20
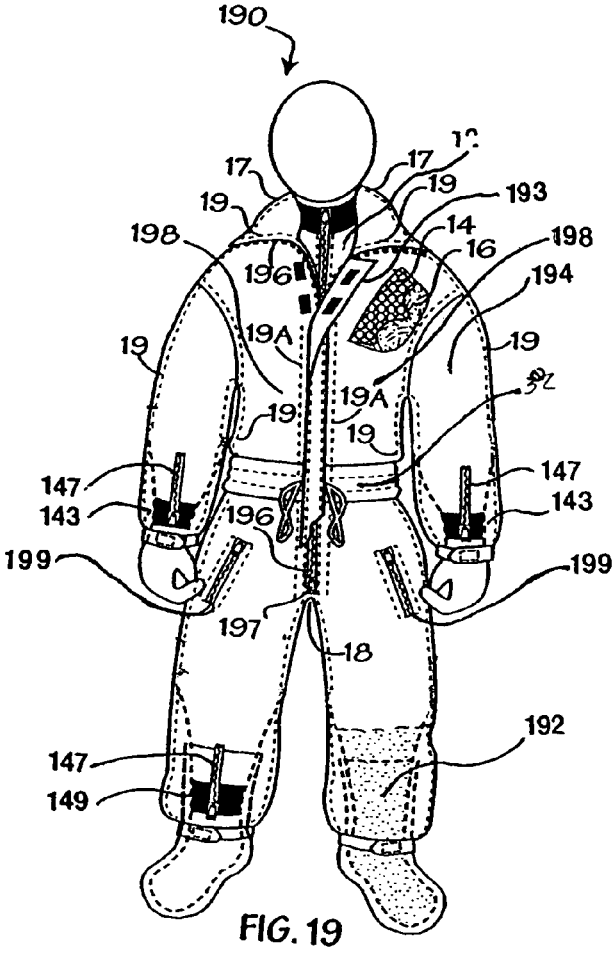
FIG. 19
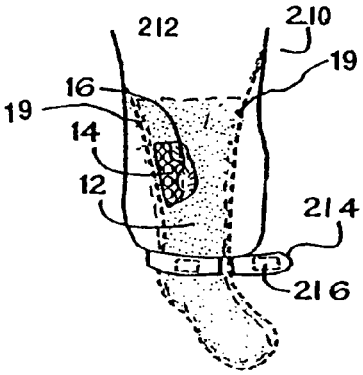
FIG. 21

LINER AND GARMENT ENSEMBLE FOR THERMAL WEAR AND ANTI-EXPOSURE SUITS

This invention claims the benefit of priority to U.S. Provisional Patent Application 60/388,208 filed Jun. 13, 2002, and relates to a light weight air encapsulated cellular thermal liner ensemble constructed of a heavy duty polyethylene or comparable polymer or monomer composition, and more particularly, this invention provides a thermal liner that is buoyant, light weight, low bulk, wind resistant, and water impermeable, which allows for increased thermal protection across wide ranges of temperatures and climates, and when used in a multi-purpose nautical work and survival suit has freedom of movement while providing flotation and hypothermia protection.

BACKGROUND AND PRIOR ART

Cold weather garments abound in the retail marketplace today. These garments are constructed from a wide range of materials and in a variety of styles depending on their use. However, their primary function is to keep the user warm while also meeting the diverse demands of various cold weather sports and activities. Such demands include freedom of movement, minimal weight, low bulk, water impermeability, moisture and wind resistance, and, for activities that occur in or around water, buoyancy.

Typical thermal liners for cold weather garments are constructed of multiple layers of material. Normally, they consist of an outer shell, a thermal layer, and an inner liner. When these liners are constructed for use in moderate temperatures, they seem to address most user requirements. However, as temperatures go down, the traditional response is to add material or increase the density of the thermal layer. This approach leads to decreased freedom of movement, added weight and bulk, increased wetting due to perspiration, poorer air circulation inside the garment, and increased manufacturing cost.

Several types of multi-layered garment liners have previously been disclosed. Generally, these liners have the following disadvantages:

(a) To achieve a comfort level at low temperatures, the amount of thermal insulating material has to be increased substantially;

(b) This increase in thermal material adds weight, bulk, and creates difficulty in mass production because of problems associated with cutting, handling, and sewing the bulky liner material typically used such as down, polyester, polygard, etc.;

(c) Increasing amounts of material tend to limit the ability of the garment to respond to changes in temperature resulting in excessive moisture due to perspiration during transition from low to high temperatures;

(d) Manufacturing processes intended to minimize the effects of thickness and bulk result in rigidity and stiffness in the product, thus limiting freedom of movement. Cost is also directly impacted.

The search for ultra light weight, inexpensive, thermal insulating material for garments has resulted in disclosures such as U.S. Pat. No. 4,583,247 to Fingerhut et.al. (1986) for a composite insulation material. While U.S. Pat. No. 4,583,247 does appear to meet weight, bulk and cost criteria when a single layer of insulation is used, it may not be sufficient to provide thermal protection in very cold temperatures without stacking layer upon layer of composite material to form the inner lining.

U.S. Pat. No. 5,140,721 to Kauffeld (1992) discloses the use of plastic bubble packing sheets to make thermal protective insulating underwear for divers.

U.S. Pat. No. 5,140,721, in its simplest form, takes sheets of bubble packing material and makes them into undergarments for divers. These inner garments have no inner or outer liners, and may or may not be worn over an inner garment.

While acknowledging the ultra light weight and excellent thermal insulating properties of plastic bubble packing material as it is used in U.S. Pat. No. 5,140,721, it is inefficient as the sole element of a thermal garment. When placed against the body, bubble packing material adheres to the skin because of the moisture created through perspiration or the outside environment. Since there is no means for absorbing this excess moisture, the comfort level of the user is degraded. Furthermore, without some type of inner wicking liner or adequate air space, ingress and egress from the fitted garment are severely hampered because of the tendency for plastic bubble packing material to cling to the body. In addition, the absence of an inner liner subjects the bubbles, especially if the non-barrier light weight bubble packaging material is used, to possible rupture. Lastly, bubble packaging material is inappropriate for a diver's dry suit in which minimum buoyancy is a highly desired characteristic.

The traditional method of forming seams in survival or anti-exposure dry suits involves gluing together a butt seam where a rubber-like glue is applied to each of the faces to be butt joined allowing the glue to dry or cure. This method has been found to have inadequate strength, particularly when the composite seams are composed of dissimilar fabric or material such as that for zipper closure tape.

In another method of forming seams, a glued and butted seam of the above type is strengthened by stitching the seams. However, when this method is used and the seam is placed under stress, the needle holes become enlarged allowing water to penetrate through the holes to the interior of the suit. This is sometimes referred to as pin holing. For example, U.S. Pat. No. 3,731,319 to O'Neill (1973) and U.S. Pat. No. 5,802,609 to Garafalo (1998) disclose a suit provided with inturned seals at the neck, ankles, and wrist to make them substantially watertight. However, there is no solution offered to prevent water intrusion due to pin holing.

A further advance in the above glued, butted, and stitched method involves gluing a flexible tape on the inside or on opposite sides of the seam which improves the seam strength and waterproof characteristics. However, with such a method, the tape, when submerged in cold water for extended periods of time, can separate from the stitched joint impacting the integrity of the waterproof seam. In the past, difficulty in formulating an adhesive bonding system that will adhere to a polymer composite such as polyethylene, particularly when using dissimilar materials, prohibited the use of a polymer liner element in watertight garments.

Thus, the need exists for solutions to the above problems with the prior art.

SUMMARY OF THE INVENTION

The primary objective of the subject invention is to provide liners and garment ensembles that can be used as a thermal wear and anti-exposure suit.

The secondary objective of the subject invention is to provide liners and garment ensembles which can meet the demands of winter sports, particularly, low activity winter sports such as snowmobiling, motorcycling, ice fishing and boating as well as cold weather work activities.

The third objective of the subject invention is to provide liners and garment ensembles that are light weight, breathable, waterproof, and wind-resistant.

The fourth objective of the subject invention is to provide liners and garment ensembles that can provide thermal protection across a wide range of temperatures and climate conditions while being compatible with the varied cold weather wear demands.

The fifth objective of the subject invention is to provide liners and garment ensembles that can be used alone or integrated into an existing outer garment.

The sixth objective of the subject invention is to provide liners and garment ensembles that can be used as a versatile, light weight garment offering freedom of movement and watertightness while providing excellent flotation properties and hypothermia protection.

The seventh objective of the subject invention is to provide thermal liner ensembles that can be used alone or integrated into an existing outer garment while being extremely lightweight.

The eighth objective of the subject invention is to provide a multi-purpose nautical work and survival suit which can be easily opened for an out-of-water work activity and closed for protection against water intrusion.

The novel invention meets all the objectives described above for a thermal wear and anti-exposure suit. The invention has performed at wind chills of approximately −46 degrees Fahrenheit when tested using a snowmobile at speeds up to approximately 73 miles per hour, and during the transition from this external environment to a room temperature of approximately 68 degrees Fahrenheit. The air encapsulated cellular layer itself weighs less than approximately 1.5 ounces per square yard. The invention has been able to show retention of air in the cellular thermal layer during a period of approximately three years.

The invention can be used alone or integrated into an existing outer garment. The jacket liner or vest ensemble can be worn as a work garment, satisfying the performance requirements of most personal flotation devices (PFDs) while weighing less than twelve (12) ounces. The jacket liner, when zipped into an existing light weight outer shell, can provide out of water winter protection.

When the watertight jacket and trouser components are combined, a multi-purpose nautical work and survival suit is created that can satisfy the need for a versatile, light weight garment offering freedom of movement and watertightness while also providing excellent flotation properties and hypothermia protection.

The invention can be configured as a multi-purpose nautical work and survival suit. Its seams can be sealed against water intrusion, made possible by the unique polymer adhesive bonding system. The leg, wrist, and neck openings can be constructed with light weight watertight closures which can be easily opened for an out-of-water work activity and closed for protection against water intrusion.

An embodiment of the invention can include a sealed air cellular or bubble material as part of the thermal liner ensemble.

A second embodiment can use the cellular thermal liner ensemble with a highly specialized sealing and bonding system to meet the growing need for a light weight, buoyant, watertight, and versatile work vest and PFD. A nautical work and survival dry suit is yet another embodiment of this three layer liner ensemble concept. The work and survival garment can be constructed to provide comfort and protection but, above all, it guarantees protection against cold water intrusion. This can only be accomplished by assuring watertight seams and closures.

In the past, difficulty in formulating an adhesive bonding system that will adhere to a polymer composite such as polyethylene, particularly when using dissimilar materials, prohibited the use of a polymer liner element in watertight garments. This impediment has been overcome, and is described in reference to FIGS. 10 and 13.

Additional objects and advantages along with the various liner configurations and methods of construction will become apparent from the drawings and description of my invention which follow.

Further objects and advantages of this invention will be apparent from the following detailed description of a presently preferred embodiment which is illustrated schematically in the accompanying drawings.

BRIEF DESCRIPTION OF THE FIGURES

FIG. 18 is a front perspective view of the neck seal in the open position with a cut-away view showing the three layer construction.

FIG. 19 is a perspective view of the nautical work suit/coverall with the watertight three layer liner ensemble of FIG. 15 incorporated and showing the three layer construction in accordance with the present invention.

FIG. 20 is a sectional view of the wrist seal in the open position and a cut-away view showing the three layer construction.

FIG. 20A is an enlarged view of the wrist seal of FIG. 20 showing the watertight adhesive bond and zipper closure means.

FIG. 21 is a sectional view of an alternate embodiment of the leg seal with cut-away view showing the three layer construction.

DESCRIPTION OF THE PREFERRED EMBODIMENTS

Figure 1:
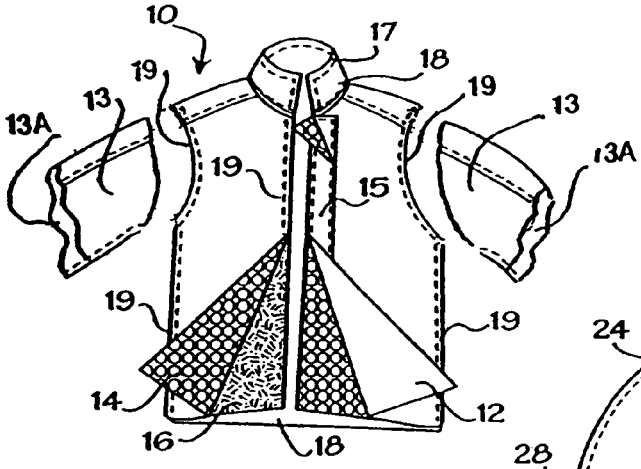
FIG. 1 is a front view of a preferred embodiment of the jacket liner ensemble constructed according to the invention with a cutaway view showing the three material layers comprising the liner and with a partially sectioned view of the arm panels removed showing a second vest embodiment.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The Reference Numerals In The Drawings Are Defined as Follows:

10 jacket liner ensemble
12 outer layer
13 sleeve front panel
13A sleeve rear panel
14 sealed air cellular thermal layer
14A multi-layer thermal liner
15 zipper flap
16 inner layer
17 common upper edges
18 common lower edges
18A shoulder panel lower edge
19 common side edges
19A work suit common side seal edges
20 jacket liner ensemble
21 bottom waistband
22 two-way separating zipper
23 pocket zipper
24 front panels
25 pockets
26 cuffs
28 sleeve front panels
30 trouser embodiment
30A rear view trouser embodiment
31 trouser front panels
31A trouser rear panels
32 waistband
32A rear waistband
33 trouser pockets
34 waistband seams
35 trouser zipper
35A unisex zipper opening
36 drawstring
37 trouser zipper flap
38 wraparound leg bands
40 integrated liner ensemble
42 host outer shell
50 vest with inflated front panels
52 inflatable vest front panels
54 primary inflator tubular member
56 inflatable valve
56A inflatable valve inner flange
58 shoulder panel
60 panels of liner ensemble
70 exploded cross-section of non-watertight seal
72 seam junction
80 cross-section of multi-layer cellular thermal layer
82 multi-layer seam junction
84 multi-layer seam junction
86 multi-layer air space
90 exploded cross-section view of a watertight seal
92 polymer adhesive bonding
94 polymer cellular layer
100 cross-section of a three layer construction
102 three layer seam junction
104 three layer seam junction
110 heat sealed watertight seam
112 heat sealing junction
114 common seam edge
120 cross-section of a two layer configuration
122 abrasive resistant finish
124 stitching junction
126 stitching junction
128 reflective coating
130 watertight adhesive seal for two layer liner
132 polymer adhesive bonding system
134 common seam edge
140 two layer thermal, watertight, buoyant liner ensemble
142 flexible watertight zipper
143 wrist seal
144 neck seal
145 fabric sock
146 front panels
147 wrist and ankle zipper closure
148 zipper tab
149 ankle seal
150 second embodiment of watertight liner
152 flexible watertight zipper
154 front panels
156 zipper tab for urinary access
160 trouser leg and boot
162 trouser leg
164 trouser leg strap
166 boot
170 hood
172 hood skirt

Figure 2:
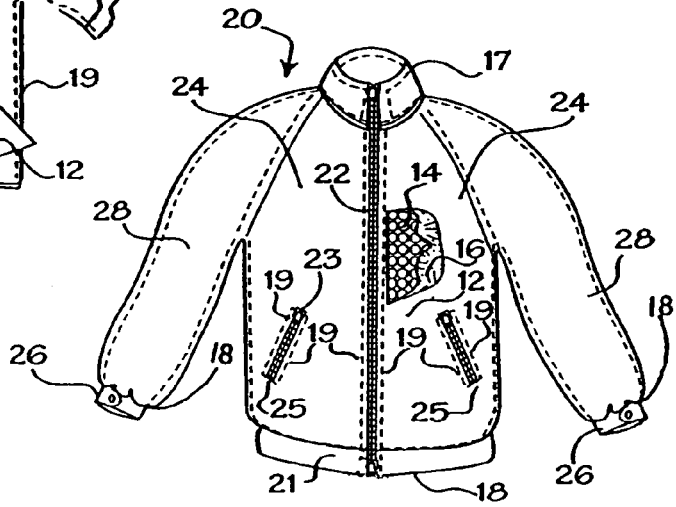
FIG. 2 is a front view of the jacket embodiment of the liner ensemble showing a means for closure and for integration with a host outer shell.
Figure 3:
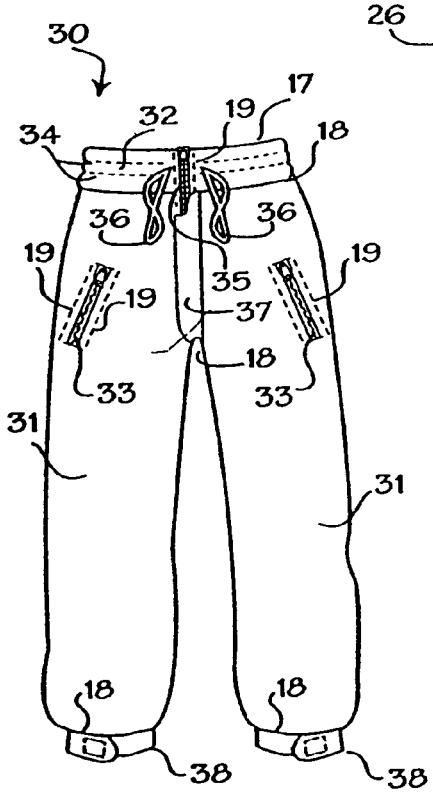
FIG. 3 is a perspective view of a trouser embodiment of the invention using the same three layer construction with pocket, ankle, and front closure incorporating a unisex urinary access.

180 three layer neck seal
182 outer shell, coverall, or work suit
183 hook and loop closure
184 neck seal watertight seam
186 outer shell zipper
188 outer shell zipper flap
190 anti-exposure and work suit embodiment
192 left ankle seal
193 zipper flap
194 one piece outer garment
195 zipper pull tab
196 outer garment zipper
197 trouser pockets
198 outer garment front panels
200 sectional view of wrist seal
202 exploded view of watertight wrist seal
204 wrist seal zipper
206 wrist seal polymer adhesive bonding system
210 lower leg and foot element seal
212 trouser leg
214 trouser leg securing strap
216 hook and loop fastener The First disclosed embodiments of the present invention are illustrated and described in reference to FIGS. 1–3. The Second disclosed embodiments of the present invention are illustrated and described in reference to FIGS. 14, 15 and 19.

Referring to FIG. 1, the garment liner ensemble comprising the basic component of the present invention is the embodiment of a jacket 10 which includes an outer layer 12, a sealed air polymer cellular thermal layer 14, and a soft wicking inner layer 16. Outer layer 12 is typically made of a light weight, preferably water resistant or waterproof material such as but not limited to GoreTex (R), Ultrex (R), nylon, and the like. The material selected can be based on the desired end use of the garment.

The sealed air cellular thermal layer 14 can be derived from a light weight, water impermeable, high strength polymer such as but not limited to polyethylene, and the like. A preferred material can be a reinforced barrier sealed air cellular polyethylene, with approximately 1/16 of an inch to approximately 1/8 inch to approximately 3/16 inch cell depth, such as but not limited to materials under the trade name Air Cap (R) or Poly Cap (R) manufactured by Sealed Air Corporation.

Inner layer 16 can be made of a light weight soft wicking fabric such as but not limited to fleece, lycra, polyester, nylon, and the like, and combinations thereof. The weight and absorption properties of the inner layer material can also be based on the desired end use and climate conditions of the garment 10.

Construction methodology for the non-watertight multi-layer garments as shown in FIGS. 1–3 can include techniques well known to anyone skilled in the art of sewing, and form the basis for all liners and components thereof according to this invention. Common edges referred to herein are side edges, upper edges, and lower edges. Side edges are all of the edges other than upper and lower edges. The term "edge" can also refer to what is generally the outer periphery of a functional component, and is not limited to the actual extreme outer limit of any one particular component. For example, the garment 10 in FIG. 1 can include upper edges 17, lower edges 18, and side edges 19.

Front panel 13 and rear panel 13A are removed to form the vest configuration. The arm opening common edges 19 can be sewn and a material such as but not limited to nylon, cotton and the like, or a material such as ribbing can be used to finish the common seam edges.

Referring again to FIG. 1, the zipper flap 15 cut-away view shows the cellular thermal layer material similar to 14 except that the sealed air cells or bubbles are significantly smaller, approximately 1/16 inch depth. The zipper flap 15 has the same three layer configuration as the basic liner ensemble in order to seal the front zipper closure against cold air intrusion and to maximize wind resistance and buoyancy.

Figure 4:
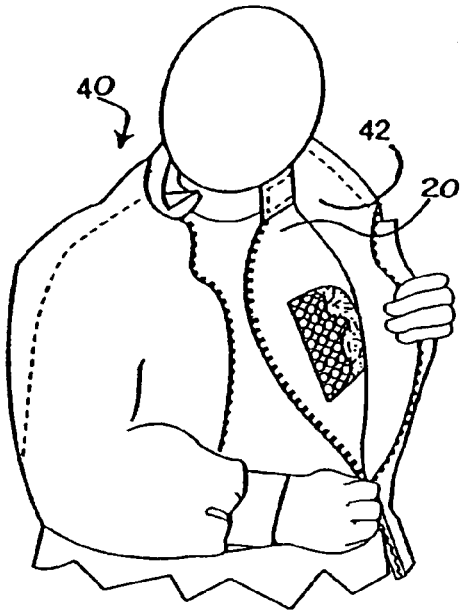
FIG. 4 is a perspective view of the liner in FIG. 2 being integrated with a host outer shell.

Referring to FIG. 2, jacket liner ensemble 20 can be worn as a stand alone thermal outer garment or as a thermal liner ensemble integrated into a host outer shell as shown in the integrated liner ensemble 40 in FIG. 4. The FIG. 2 cut-away view shows the same multi-layer configuration, outer layer 12, second or thermal layer 14 and inner layer 16, as illustrated in the jacket liner assemble in FIG. 1. The closure fastener 22 can be a two-way separating zipper such as but not limited to the YKK No. 5 Vislen (molded tooth) type suitable for mating with the host outer shell. The front closure fastener 22 can be attached to common side edges 19. The term "closure fastener" and zipper are used interchangeably. However, the closure fasteners are not limited to zippers and can include a range of closure devices such as but not limited to rib and track, hook and loop fasteners, and the like. Also, the term "common edges" hereafter refers to the seam edge composed of all component layers that includes: outer layer 12, the interposed sealed air cellular thermal layer or layers 14, and inner layer 16. The closure and mating fastener extends down the front of the garment along the center line of the front panels 24 from upper common edges 17 to lower common edges 18. Cuffs 26 can be sewn to the ends of sleeve 28 rear and front panels at lower common edges 18 and can be adjustable in circumference to fit different wrist sizes. Therefore, cuffs 26 should have an adjustable closure fastener, such as but not limited to a button, elastic, hook and loop fasteners, and the like, such as those commercially available under the trade mark Velcro (R), to vary the size of the cuff openings. The waist band 21 can include an adjustable fastener such as but not limited to elastic or a drawstring arrangements to adjust the bottom waist band 21 snugly around the wearer when worn as an outer garment. Pockets 25 are optional when jacket liner ensemble 20 FIG. 2 is intended for integration with an existing off-the-shelf commercially available host outer shell as illustrated in integrated liner ensemble 40 FIG. 4. Pockets 25 can have closure elements 23 similar to the front closure element 22 and also can be sewn to their common side edges 19.

Referring to FIG. 3, trouser 30 is another embodiment of the same multi-layer construction thermal liner garments depicted in FIGS. 1, 2, and 19. Waist band element 32 is constructed of fabric layers and sewn to trouser 30 at its lower common edge 18. Elastic bands such as but not limited to polyester elastic type 70E and drawstring 36 are sewn between the fabric layers of waist band 32 at seams 34. Drawstring 36 can be attached laterally or circumferentially about the waist allowing adjustments of the elastic to conform to the features of the waist and for securing the liner ensemble 30 in the proper vertical position. Wraparound bands 38 can be sewn to the ends of the trouser legs at common lower edges 18 and fitted in the same manner as the cuffs 26 in FIG. 2. Pockets 33 can have closure fasteners similar to fasteners 23 in FIG. 2 and can be sewn to their common side edges 19. The front closure fastener 35 can be a two way separating zipper closure similar to the YKK type fastener 22 in FIG. 2. The front closure fastener 35 can be attached to common edges 19 of the front panels 31 and extended along the center line of the trouser panels 31 from upper edge 17 down through lower front closure edge 18, and upwardly along the center line of rear panels 31A as shown in 35 FIG. 3A. Zipper 35, therefore, provides for a unisex urinary access opening. The zipper flap 37 shown in FIG. 3, like flap 15 shown in FIG. 1 can be optional and is not always desirable when a unisex opening is required.

Figure 3A:
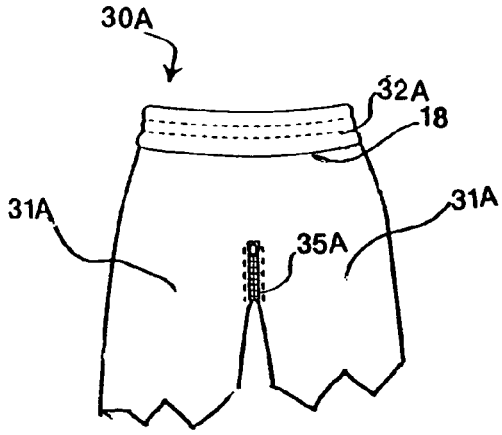
FIG. 3A is a sectional rear view of the trouser in FIG. 3 showing the lower termination of the front closure means and unisex urinary access.

FIG. 3A is a rear sectional view of the trousers 30 in FIG. 3 showing the urinary access zipper 35A extending upwardly along the center line of rear panels 31A to a point approximately two thirds (⅔) the distance down from lower edge 18 of waist band 32.

Referring to FIG. 4, integrated liner ensemble 40 illustrates the integration of the liner ensemble 20 with a commercially available outer shell 42. Outer shells similar to item 42 are abundant in the commercial, winter sportswear marketplace.

Figure 5:
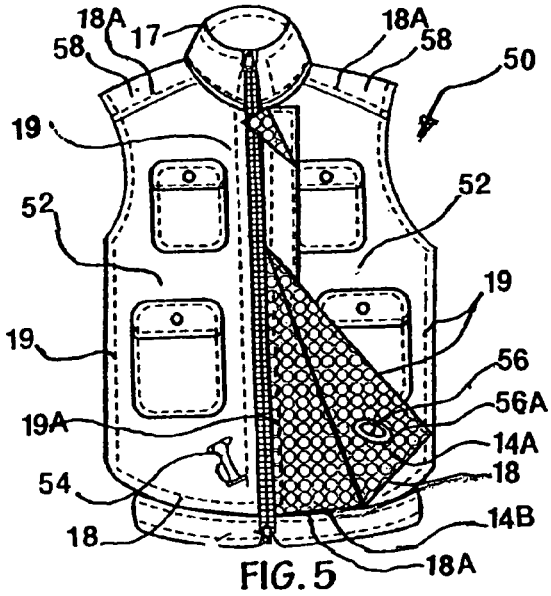
FIG. 5 is a front view of a work vest with inflatable front panels using the same three layer construction shown in FIGS. 1 and 2.
Figure 8:
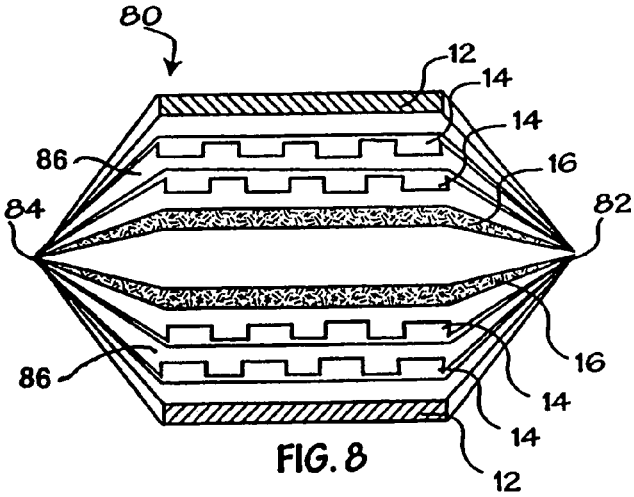
FIG. 8 is a cross-section view of a panel seam showing two polymer cellular thermal layers encased between their respective inner and outer layers and joined at a common seam.

Referring to FIG. 5, vest 50 with inflated panels is yet another embodiment of the multi-layer liner and garment ensemble illustrated in FIGS. 1–2. The garment 50 can be a light weight work and sports vest which also satisfies all basic requirements for a PFD. The inherent buoyancy of the work and sports vest 50 can be further enhanced by adding additional layers of the polymer sealed air cellular layer, as illustrated in FIG. 8, to front panels 52 shown in FIG. 5. Front panels 52 layers 14A and 14B are sewn and adhesively bonded at seams 18A, 19A, and shoulder panel 58 lower edges 18A using the process described for FIGS. 9 and 11. This process can create an airtight seal of the panel, as illustrated in detail in the multi-layer seam junctions 82 and 84 shown in FIG. 8. Specific details of the sealing process will be described under the two layer thermal, watertight, buoyant liner ensemble 140 shown in FIG. 14.

Referring to FIG. 5, the air space created between front panel layers 14A and 14B, when fully inflated, creates a bladder that surrounds the chest and abdomen area. The inflatable front panels 52 can greatly improve the righting ability and flotation of vest 50. Calm water testing has demonstrated a significant improvement in buoyancy when inflatable front panels are incorporated into the liner ensemble 20 shown in FIG. 2.

The FIG. 5 illustration shows an oral inflation mechanism 54 where air is blown into the bladder or chamber using the inflator tube 54. It should be understood, that the method of inflation should not be limited to oral alone, but can include automatic or manual techniques. In calm water, the garment's inherent buoyancy, without being inflated, can also provide adequate flotation. The inflation valve assembly 56 can be composed of a tubular member 54 and the base component of the inflatable valve assembly 56. The valve assembly 56 can be bonded to the outer cellular thermal layer 14A and the outer inflation valve flange 56A. The adhesive bonding system is as described for flexible water tight zipper (fastener) 142 shown in FIG. 14. The airtight lower adhesive seal 18A and the inflator valve 56 can be moved in an upward direction along front panels 52, thereby adjusting the buoyancy while optimizing flotation and righting performance.

Figure 5A:
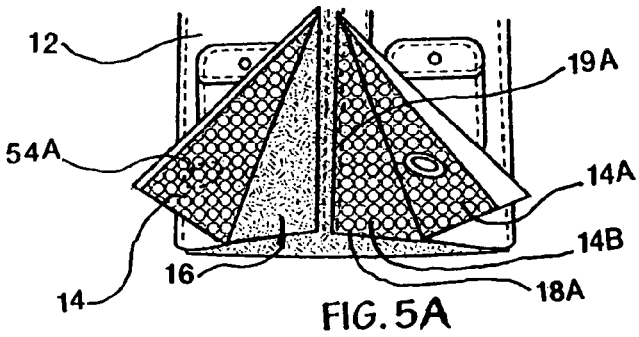
FIG. 5A is a front sectional view of the vest in FIG. 5 showing the sealed edges of the inflatable multi-layer cellular front panels with attached inflation device.

FIG. 5A is a sectional view of the vest lower front panels as shown in FIG. 5. The purpose of this illustration is to show the construction of the multiple cellular layer 14. The left lower front panel shows the inner surface of the outer cellular thermal layer 14A as described in FIG. 5. Layer 14A is shown prior to being bonded to the inner cellular layer 14B at lower edges 18A and side edge 19A. Following the bonding process, the resulting right and left cellular front panels 14 can be sewn to the outer layer 12 and inner layer 16, and secured to the zipper tape at side edge 19 in the same manner as the fastener 22 in FIG. 2. The zipper can be sewn at the common edges without impairing the watertight integrity of the sealed cellular thermal liner.

Figure 6:
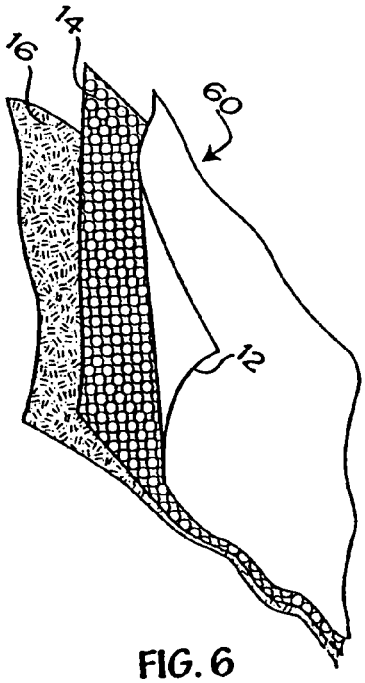
FIG. 6 is a perspective view showing a piece of the polymer cellular thermal layer interposed between the inner and outer layers.

FIG. 6 shows the panels of the liner ensemble 60, prior to being sewn or otherwise sealed to fabric layers. The cellular thermal layer of the polymer material 14 is sandwiched between the soft wicking inner layer fabric 16 and the outer fabric layer 12. The primary purpose of outer layer 12 is to protect the more sensitive outer surface of the loose fitting cellular thermal layer 14 when worn with a host outer shell. However, when the liner ensemble is incorporated into a stand-alone garment such as that illustrated in FIGS. 1, 3, and 19, the outer layer fabric 12 or outer shell can be selected for its utility and durability based on intended use.

Figure 7:
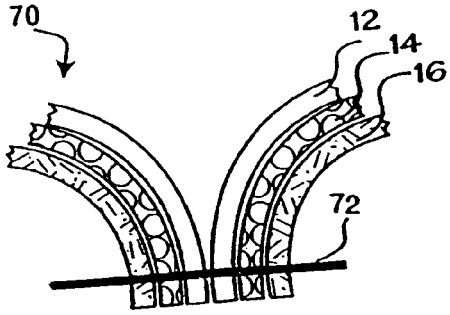
FIG. 7 is a cross-section view of one embodiment of a non-watertight seam in accordance with the present invention.

In accordance with the preferred embodiment of the invention, and referring to the exploded view 70 FIG. 7, layers 12, 14, and 16 of the liner ensemble material can be sewn together to form a common seam junction 72. The panels can be laid side by side with the wrong side or inner layer fabric 16 facing outward, as illustrated in FIG. 7, and stitched along junction 72. When the stitching process is complete, the panels can be turned right side out, as is common practice when sewing multi-layer garments.

FIG. 8 is an enlarged cross-section view of a second liner embodiment 80 of a multi-layer cellular thermal layer 14 configuration. Layers 12, 14A, 14B, and 16 common edges are joined at junctions 82 and 84, to form the common panel seams. Selected multi-layer panels can be sealed using the bonding system described for FIGS. 9 and 11 allowing for space 86 between polymer cellular layers 14A and 14B which can then be inflated to provide additional buoyancy. The sealed air polymer cellular thermal layers 14A and 14B in all cases have their bubble surfaces facing inwardly toward the body or inner layer 16 allowing air to circulate around the dead air space created by the cellular matrix structure. This arrangement provides insulation against heat transfer to maximize comfort when used in an out of water environment. In an alternate embodiment, the bubble surface of layers 14 can be coated with a reflective finish, as in FIG. 12, to further contain the infrared heat energy radiated by the user's body. This phenomenon is most prevalent when the reflective face is on the surface toward the wearer's body, for example, on the side where the highest temperature occurs.

Figure 9:
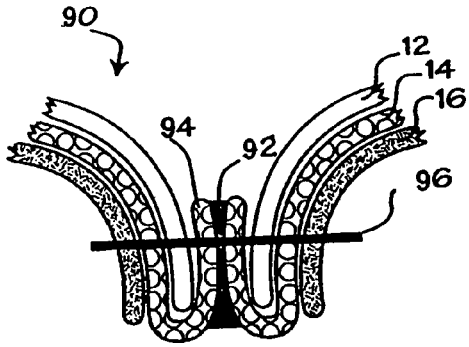
FIG. 9 is a cross-section view of a second seam embodiment of the present invention showing a watertight polymer adhesive bonding process in accordance with the present invention.

FIG. 9, in accordance with the second embodiment of the invention, is a cross-sectional view 90 of a watertight seam using a sealing process such as but not limited to the Master Bond Polymer System X17 and adhesive EF 30HT or, where dissimilar materials are used, EP21TDC-4 to bond the surfaces of the cellular thermal layers 14. In preparation for sealing, the cellular thermal layers 14 can be folded in and around outer layers 12 to bring the cellular layers 14 edges 94 into a coincident relationship. The inner surface of the extended layers 14 can then be treated with, for example, the polymer primer X17 and bonded using, for example, an adhesive seal 92 similar to EF 30HT, EP21TDC-4, and the like. The bonded seam can then be stitched to outer layer 12 and inner layer 16 at common edges 96 and the stitches sealed using an adhesive identified above. The stitching process can enhance the lateral strength of the seam only, and does not impact the seam's watertightness.

Figure 10:
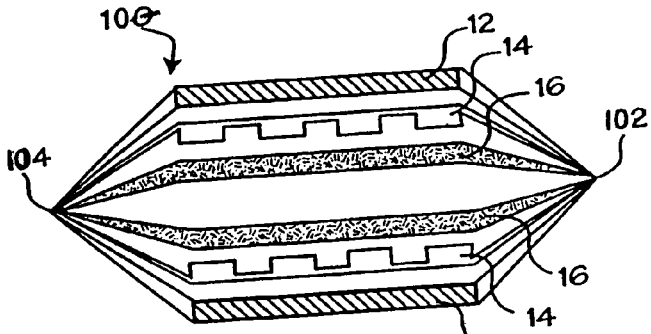
FIG. 10 is a cross-section view of a multi-layer panel seam showing a single polymer cellular thermal layer encased between its respective inner and outer layers and joined at a common seam.

FIG. 10 is a cross-section of a three layer liner configuration 100 shown in the ensemble 60 of FIG. 6 in which outer layers 12, sealed air polymer cellular thermal layer 14, and inner layer 16 can be joined together at junctions 102 and 104 to form the common panel seam.

Figure 11:
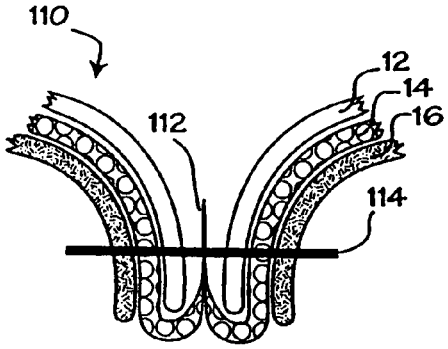
FIG. 11 is a cross-section view of yet another embodiment showing a heat sealed watertight seam in accordance with the present invention.

The watertight seam 110 FIG. 11 is another embodiment constructed similar to the watertight seam 90 FIG. 9 except layers 14 can be heat sealed at junction 112 prior to being stitched at common edges 114.

Figure 12:
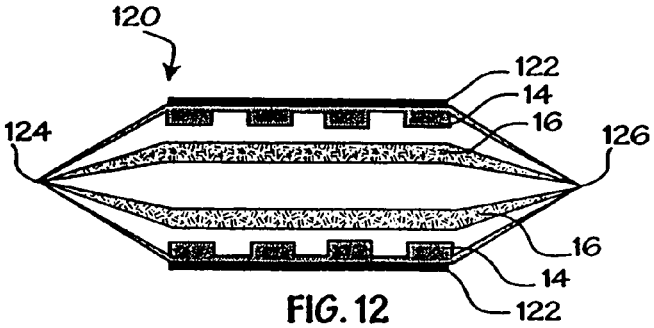
FIG. 12 is a cross-section view of a two layer panel seam showing the inner layers interposed between the reflective and thermal coated cellular thermal layers sealed at their common edges.

Yet another embodiment of a watertight seam 120 is shown in FIG. 12 and can include two layers of materials: the cellular thermal layers 14 and the inner layers 16. The polymer layers 14 can be sealed using the polymer adhesive bonding or heat sealed system, and the like, as described in FIGS. 9 and 11. An optional reflective coating 128 is shown on inner layers 14 surfaces facing the body of the user to minimize heat transfer. A flexible coating such as but not limited to a silicone rubber adhesive layer, and the like, can provide an abrasive resistant finish 122. Following the bonding process, layers 14 and 16 can be stitched and/or sealed at junctions 124 and 126 to form common seams.

Figure 13:
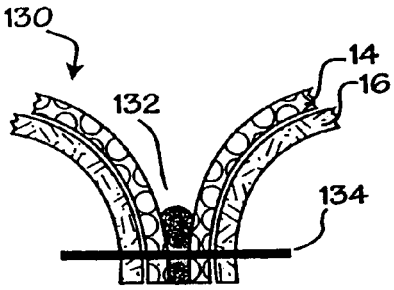
FIG. 13 is yet another embodiment of a seam using a watertight adhesive bonding process for a two layer configuration watertight liner ensemble.

FIG. 13 is a perspective view of a watertight seal 130 used for the two layer liner ensemble 120 illustrated in FIG. 12. The heat seal or adhesive bonding system 132 of cellular layers 14 is as described for FIGS. 9 and 11. The sealed and bonded seam can be stitched to inner layer 16 at common seam edges 134.

Figure 14:
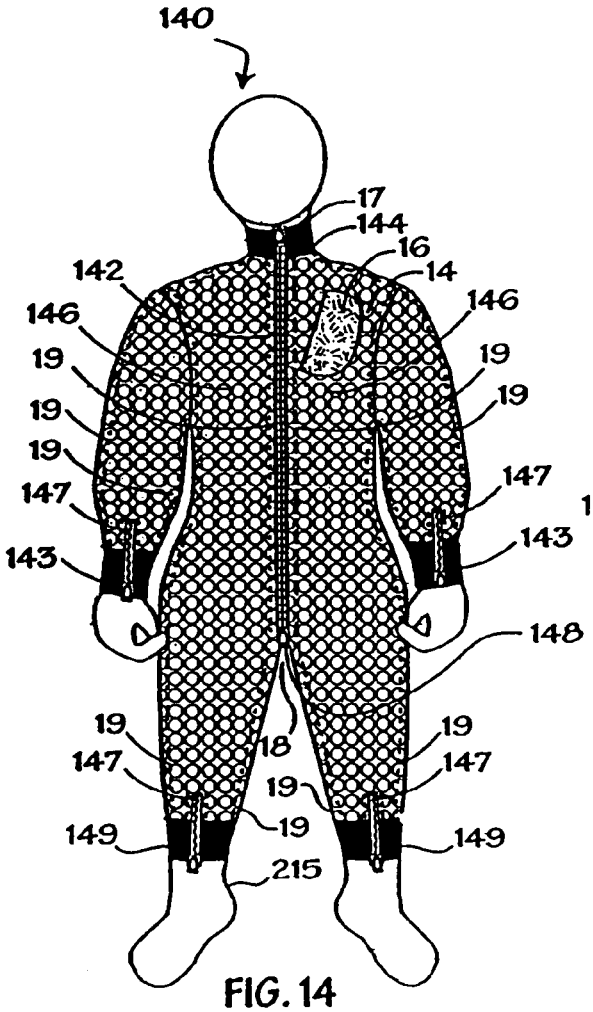
FIG. 14 is an overall view of a two layer polymer cellular thermal liner ensemble constructed as illustrated in FIGS. 12–13 showing the front closure, neck, wrist, and leg seals in accordance with a second preferred embodiment of the present invention.

FIG. 14 is an embodiment of a thermal, watertight, and highly buoyant liner ensemble 140, and can be worn inside an existing anti-exposure coverall and work suit. The water impermeable cellular thermal outer layer 14 can provide heat insulating and floatation properties while keeping the soft, wicking inner layer 16 dry. In addition, the hydrophilic inner layer 16, because of its inherent ability to transmit moisture, can pass any water vapor due to perspiration. The cellular thermal layer 14 inner surface can be coated with a reflective finish to more efficiently reflect heat energy created by the user's body as illustrated in the reflective coating 128 in FIG. 12. A protective coating applied on the outside of layer 14 is recommended to reduce wear resulting from abrasion created by the rubbing action of the inner surface of the work suit or outer shell against the unprotected outer surface of layer 14, as previously illustrated in the abrasive resistant finish 122 in FIG. 12. A light weight outer layer, however, such as nylon or a comparable fabric is preferred over an outer coating.

The preferred method for donning and doffing the liner ensemble 140 in FIG. 14 can be a watertight fastener 142 such as but not limited to the SEY85 light weight and flexible zipper manufactured by DYNAT, a member of the YKK Group, and the like. The inner surface of the zipper tape, a component of the watertight zipper, is bonded to the outer or inner surface of the cellular layer 14, sewn to inner layer 16, and sealed using the adhesive process 90 described for FIG. 9. The zipper tape and material layers common seal can be attached at common side edges 19 midway between front panels 146. The front closure fastener extends from the upper edge 17 of the neck seal down the center line of front panels 146 to lower edge 18.

Due to the dissimilar materials of the zipper tape, inner layer 16, and the polymer cellular thermal layer 14, the preferred bonding process used to ensure a watertight front closure 142 seal is to apply a polymer primer such as Master Bond X17 on the zipper tape inner surface to be bonded and the outer surface of the cellular layer 14 followed by an application of a suitable polymer adhesive compatible with dissimilar materials such as but not limited to EP21 TDC-4, and the like. EP21 TDC-4 is a flexible epoxy used when bonding a polymer to one or more dissimilar materials. This adhesive can be applied with a spatula, knife, trowel, brush, roller, etc. to a thickness of approximately 4 to 6 mils. Porous surfaces may require more adhesive to fill the voids. The bonded parts should be pressed together with just enough pressure to obtain and maintain intimate contact during cure. The Master Bond Polymer System EP21TDC-4 can be cured at room temperature or more rapidly at elevated temperatures, as desired. Maximum bond strength is achieved within 48 hours. The water impermeable wrist seal 143, neck seal 144, and ankle seal 149 are constructed of an elastic material fashioned of a laminate rubber, neoprene or the like and bonded using the same adhesive bonding process described above. The seals described herein must have watertight zippers 142 and 147 in the closed position, as illustrated, to complete the watertight seal. A two-way watertight zipper is preferred for front closure 142. Otherwise, a separate urinary access closure means will be required. When a two-way watertight zipper is used, pull tab 148 allows for an optional urinary access opening. A knitted stretch fabric in the form of hosiery, stocking material, or woolen sock 145 can be worn over the polymer ankle seal 149 for warmth and to more easily don and doff the footwear. Liner ensemble 140 is most suitable for use when working in or around water of moderate temperatures.

Figure 15:
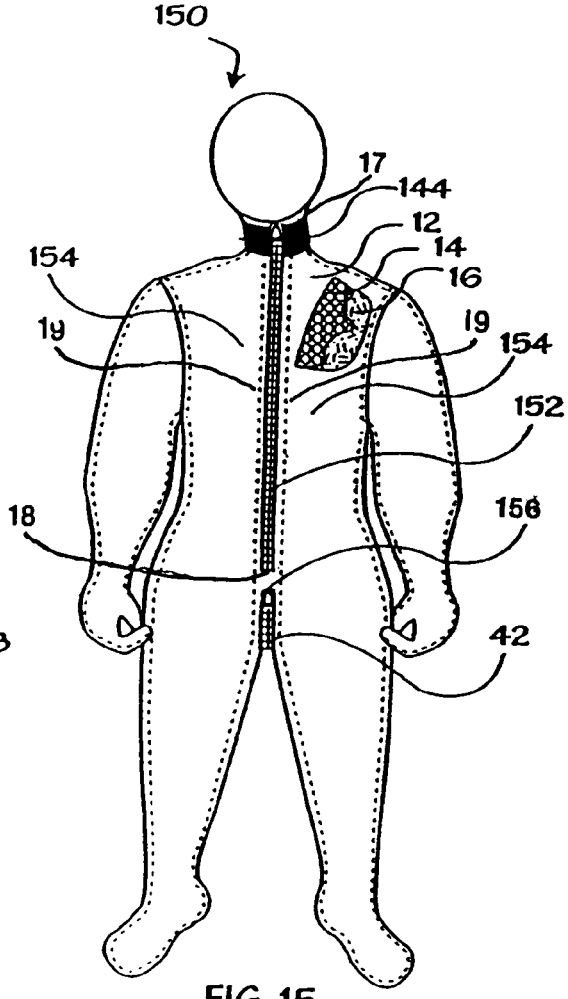
FIG. 15 is a three layer polymer cellular liner ensemble constructed as illustrated in FIG. 9 and FIG. 10 in accordance with the present invention.

FIG. 15 shows another embodiment of the watertight liner ensemble 150 similar to the embodiment 140 of FIG. 14 using the three layer construction method, outer layer 12, cellular thermal layer 14, and inner layer 16. The front closure 152 is a one-way flexible watertight zipper similar to that described for the fastener 142 of FIG. 14 and is attached to common side edges 19 along the centerline of front panels 154 extending from upper edge 17 of neck seal 144 in a downward direction to the zipper lower edge 18. Zipper 156 is similar to the fastener 35 FIG. 3A, and provides for a urinary access opening controlled by zipper tab 158. The zipper tape is attached to the common side edges 19 in the same manner as the front closure fastener 152. The adhesive bonding process for watertight zippers 152 and 158 is as described for front closure 142 FIG. 14. An optional unisex urinary access 156 similar to the access 148 in FIG. 14 can also be provided.

Figure 16:
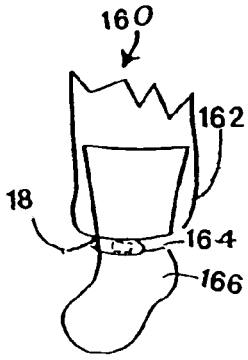
FIG. 16 is a partially sectioned view of the boot and outer shell ankle closure.

FIG. 16 is a sectional view 160 of the trouser leg 162 and the boot 166 component. The boot can easily slide over the outer fabric of liner ensemble 150 FIG. 15 allowing the footwear to be easily donned and doffed. The adjustable trouser strap 164 can be attached to the trouser leg 162 at lower edge 18 in the same manner as described for the bands 38 in FIG. 3.

Figure 17:
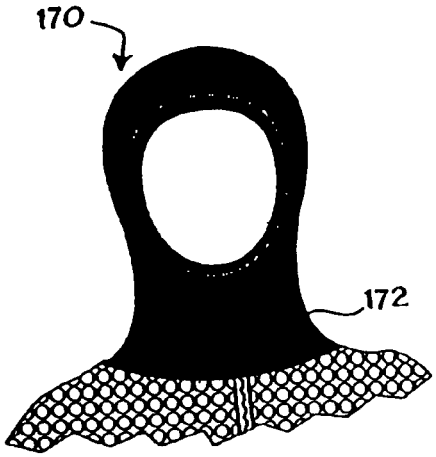
FIG. 17 is a partially sectioned view of the two layer liner ensemble in FIG. 14 provided with a hood according to the invention.

FIG. 17 shows a hood 170 having a smooth elastic material such as neoprene or rubber. The hood skirt 172 fits tightly over neck seal 144. The hood is commercially available, and can be purchased at most nautical supply centers.

FIG. 18 is an exploded view 180 of the three layer liner ensemble neck seal 144 with the front closure means 152 in the open position. A cutaway view shows the liner ensemble of 150 FIG. 15 three layer construction, outer layer 12, the water impermeable polymer cellular layer 14, and soft wicking inner layer 16. The watertight neck seal 144 can be a water impermeable elastic material, similar to that described for the neck seal 144 in FIG. 14, which forms a tight fit against the wearer's skin. The primary purpose of the liner ensemble 150 FIG. 15 outer layer 12 is to minimize wear due to friction resulting from the rubbing action of the heavier outer shell, coverall, or work suit 182. The polymer cellular layer 14 can be bonded to the inner surface of the neck seal 144 at seam 184. The bonding system for neck seal seam 184 can be similar to the one described for the front closure 142 in FIG. 14. The outer shell zipper 186 common seam edge 19 construction is more clearly defined in this exploded view and will be discussed further in the following drawing FIG. 19. Zipper flap 188 conceals zipper 186, provides additional thermal protection, and guards against foreign objects coming in contact with the outer shell zipper when flap 188 is in the closed position. The inner surface of flap 188 can be secured to the zipper opposite side edge using a hook and loop 183 type of arrangement such as Velcro (R).

FIG. 19 shows another embodiment for providing a multi-purpose work and survival or anti-exposure suit 190. A cutaway view shows the three layer construction of the liner ensemble, outer layer 12, cellular thermal layer 14, and inner layer 16, as illustrated in 150 FIG. 15. The wrist and ankle seals 143 and 149 are as illustrated in FIG. 14. Fasteners 147 such as but not limited to zipper closures can be used for both the watertight wrist seal 143 and ankle seal 149, and can be similar to the fastener 142 as described for FIG. 14. Fasteners 147 can be bonded to the liner ensemble in the same manner as 142. The alternate left leg seal 192 is as illustrated in the embodiment 150 in FIG. 15, and is described later in exploded view FIG. 21. The outer shell or coverall 194 can include two basic embodiments of the present invention: the jacket 10 shown in FIG. 1 and the trouser 30 FIG. 3. These two embodiments can be joined together at waist 32 of trouser 30 FIG. 3 to form the one piece suit or outer shell 194. The loose fitting liner ensemble 150 FIG. 15 can be worn inside an existing off-the shelf coverall or work suit. Ensemble 150 can also be bonded and stitched to the outer garment at common side edges 19 and 19A as illustrated in the embodiment 190 of FIG. 19. When configured as a work and survival suit, all common seams should be sealed as illustrated in FIG. 9 using the bonding system described for FIG. 14. Common side edges 19A are positioned approximately two inches either side of the center line, or front closure 196, dividing front panels 198, and extending in a downwardly direction starting at approximately twelve inches down from upper edge 17 to lower edge 18. The coverall or outer shell front closure means 196 is a two-way separating non-watertight zipper (fastener) similar to that described for the fastener 22 in FIG. 2. Zipper 196 can extend along the center line of front panels 198 starting at upper edge 17 and extending in a downwardly direction to lower edge 18 and zipper pull tab 195. The zipper flap 193 lower edge is cut-away showing the lower extremity of zipper 196 and zipper tab 195. Zipper tab 195 is part of the two-way front closure means 196. Moving the zipper tab 195 in an upwardly direction controls the size of the urinary access opening. Work boots 166 are of a type generally worn by commercial fishermen, oil rig workers and the like. Pockets 197 can be similar to those as described for 33 FIG. 3.

FIG. 20 is a sectional view 200 of wrist seal 143. A cut-away view shows the three layer construction, layers 12, 14, and 16 of the incorporated polymer cellular thermal liner ensemble. The watertight seal is illustrated in greater detail in exploded view 202 shown in FIG. 20A. Zipper 204 is shown in the open or work position and is of a similar design as the one-way watertight zipper (fastener) 142 illustrated in FIG. 14. The adhesive bonding system 206 is as described for 142 FIG. 14.

FIG. 21 is a more detailed sectional view 210 of an alternate leg seal showing the outer shell or coverall leg element seam 212 and inner liner ensemble with a cut-away that again shows the three layer configuration 200 as described for FIG. 20. The bottom of the trouser leg extending from seam 212 can be secured with a strap 214 and fastener 216 similar to the one described for 38 FIGS. 3 and 183 FIG. 18. Strap 214 can be attached laterally about the ankle portion of the boot 166. Boot 166 slides easily over outer fabric layer 12 of the liner ensemble 150 FIG. 15 allowing the wearer to easily don and doff the footwear.

Although the invention is described in detail herein for the purpose of illustration, it is to be understood that such detail is solely for that purpose. Numerous applications of the present invention will readily occur to those skilled in the art. Therefore, it is not desired to limit the invention to the specific examples disclosed or the exact design and construction shown and described. Rather, all suitable modifications may be construed as falling within the scope of the invention.

As various changes could be made in the above construction without departing from the scope of the invention, it is intended that all matter contained in the above description or shown in the accompanying drawings shall be interpreted as illustrative and not in a limited sense.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A water impermeable, loose fitting, buoyant liner ensemble and garment that provides buoyancy floatation effects while offering protection against the effects of extreme temperatures, climate conditions, and cold water exposure, comprising:

a wearable portion; and a multi-layer construction in the wearable portion consisting of a polymer sealed air cellular layer interposed between a protective outer fabric layer and a soft inner fabric layer with presealed air cells having depths of approximately ⅛ of an inch facing inwardly toward the inner layer and person's body, wherein said polymer cellular layer being light weight and buoyant includes a multiplicity of air encapsulated cells in a cell matrix with air retention being approximately three years, wherein said cells containing static air which are spaced thereby imparting body temperature control due to free air circulation about the cell matrix.

2. The liner ensemble and garment of claim 1, further comprising:

inflatable front panel separated from the presealed air cells;

means for joining multi-layer waterproof and non-waterproof common panel seams together;

means for securing extremities and openings for garment ingress and egress;

means for integrating the ensemble and garment with a host outer shell means for incorporating the inflatable front panels into the polymer cellular layer; and means for inflating the inflatable front panels.

3. The liner ensemble and garment of claim 1, wherein the wearable portion includes: a vest portion.

4. The liner ensemble and garment of claim 1, wherein the wearable portion includes: a jacket portion.

5. The liner ensemble and garment of claim 4, wherein the jacket portion includes:

removable sleeves that form a work vest.

6. The liner ensemble and garment of claim 1, wherein the wearable portion includes: a trouser portion.

7. The liner ensemble and garment of claim 1, wherein wearable portion includes:

both a jacket portion and a trouser portion.

8. The liner ensemble and garment in claim 1, wherein said outer layer includes a water repellent fabric, the inner layer includes a soft light weight, low absorbent fabric, and the polymer sealed air cellular layer includes a light weight polyethylene having a reinforced barrier layer and cellular surface to resist greater weight and pressure.

9. The liner ensemble and garment of claim 3, wherein the vest portion includes:

inflatable front panels consisting of double layers of said light weight polyethylene cellular material with a watertight seal that is useful as a flotation device.

10. The liner ensemble and garment of claim 9, wherein the inflatable panels include:

an inflatable bladder having an inflator operatively coupled to the bladder.

11. The liner ensemble and garment of claim 7, further comprising:

a zipper for securing the garment access opening and pockets; and hook and loop means for securing garment extremities, the garment extremities selected from at least one of: a wrist and an ankle.

12. The liner ensemble and garment of claim 1, further comprising:

a zipper for integrating said liner ensemble and garment with a host outer shell.

13. The liner ensemble and garment of claim 1, wherein the trouser portion includes:

a waist band portion having at least one of: an elastic material and a drawstring about a waist of the wearer;

a fastener provided for a unisex urinary access opening;

a multi-layer fastener flap having a cellular thermal layer;

ankle fasteners for wrapping about ankles; and fasteners for opening and closing at least one pocket.

14. A garment ensemble for thermal wear and anti-exposure suits, comprising:

a wearable liner ensemble comprising:

an outer layer having an abrasive resistant finish on an outer surface;

a sealed air cellular thermal layer formed from a light weight, water impermeable, high strength polymer; and an inner layer made of a light weight soft wicking fabric, said sealed air cellular thermal layer sandwiched between said inner layer to form said wearable liner ensemble and an inner surface of said outer layer;

an outer shell selected for its utility and durability based on an intended use of said garment ensemble;

attachment means for attaching said outer shell with said wearable liner ensemble to form said garment ensemble; and a closure fastener for securing the garment ensemble on the body of a wearer, wherein said garment ensemble is one of a jacket, a vest and a trouser.

* * * * *